US009650863B2

(12) United States Patent
Giusti, Jr.

(10) Patent No.: US 9,650,863 B2
(45) Date of Patent: May 16, 2017

(54) SAFETY VALVE SYSTEM FOR CABLE DEPLOYED ELECTRIC SUBMERSIBLE PUMP

(75) Inventor: Frank Giusti, Jr., Pilot Point, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 801 days.

(21) Appl. No.: 14/122,128

(22) PCT Filed: May 25, 2012

(86) PCT No.: PCT/US2012/039681
§ 371 (c)(1),
(2), (4) Date: Nov. 25, 2013

(87) PCT Pub. No.: WO2012/166643
PCT Pub. Date: Dec. 6, 2012

(65) Prior Publication Data

US 2014/0090836 A1 Apr. 3, 2014

Related U.S. Application Data

(60) Provisional application No. 61/491,017, filed on May 27, 2011, provisional application No. 61/504,035, filed on Jul. 1, 2011.

(51) Int. Cl.
*E21B 34/06* (2006.01)
*E21B 33/12* (2006.01)
(Continued)

(52) U.S. Cl.
CPC ..... *E21B 34/06* (2013.01); *E21B 33/1208* (2013.01); *E21B 34/10* (2013.01); *E21B 44/005* (2013.01)

(58) Field of Classification Search
CPC .. E21B 17/023; E21B 17/026; E21B 33/1208; E21B 33/1295; E21B 34/06; E21B 34/10; E21B 44/005
See application file for complete search history.

(56) References Cited

U.S. PATENT DOCUMENTS 3,825,078 A * 7/1974 Heilhecker ..... E21B 17/003 166/385
3,861,464 A * 1/1975 Boyadjieff ..... E21B 34/16 166/332.8
(Continued)

FOREIGN PATENT DOCUMENTS

WO 2012166643 A2 12/2012
WO 2012166643 A3 12/2012

OTHER PUBLICATIONS

Filing receipt and specification for provisional patent application entitled "Safety Valve System for Cable Deployed Electric Submersible Pump," by Frank Giusti, Jr., filed May 27, 2011 as U.S. Appl. No. 61/491,017.
(Continued)

*Primary Examiner* — Waseem Moorad
*Assistant Examiner* — Christopher Sebesta
(74) *Attorney, Agent, or Firm* — Scott Richardson; Baker Botts L.L.P.

(57) ABSTRACT

A safety valve for downhole use in a well comprises a valve body having a longitudinal bore for fluid flow; a bore closure assembly positioned to seal about a longitudinal cable within the bore; and a control assembly positioned and configured to actuate in response to a change in a control signal condition.

18 Claims, 3 Drawing Sheets

(51) Int. Cl.
*E21B 34/10* (2006.01)
*E21B 44/00* (2006.01)

(56) References Cited

U.S. PATENT DOCUMENTS

| | | | | |
|---|---|---|---|---|
| 4,049,052 | A | 9/1977 | Arendt | |
| 5,287,879 | A * | 2/1994 | Leggett | E21B 33/062 137/246.22 |
| 5,829,464 | A | 11/1998 | Aalto et al. | |
| 6,202,764 | B1 * | 3/2001 | Ables | E21B 17/025 166/242.5 |
| 6,375,155 | B1 | 4/2002 | Janssens | |
| 6,427,778 | B1 * | 8/2002 | Beall | E21B 34/00 166/321 |
| 8,118,104 | B2 | 2/2012 | Fontenot, Jr. et al. | |
| 2004/0134653 | A1 * | 7/2004 | Khomynets | F04F 5/44 166/250.15 |
| 2009/0090511 | A1 * | 4/2009 | Zupanick | E21B 17/023 166/369 |
| 2009/0183883 | A1 * | 7/2009 | Fontenot, Jr. | E21B 34/12 166/373 |

OTHER PUBLICATIONS

Filing receipt and specification for provisional patent application entitled "Safety Valve System for Cable Deployed Electric Submersible Pump," by Frank Giusti, Jr., filed Jul. 1, 2011 as U.S. Appl. No. 61/504,035.

Foreign communication from a related counterpart application—International Search Report and Written Opinion, PCT/US2012/039681, Dec. 18, 2012, 8 pages.

* cited by examiner

SAFETY VALVE SYSTEM FOR CABLE DEPLOYED ELECTRIC SUBMERSIBLE PUMP

CROSS-REFERENCE TO RELATED APPLICATIONS

This application is a filing under 35 U.S.C. 371 of International Application No. PCT/US2012/039681 filed May 25, 2012, entitled "Safety Valve System for Cable Deployed Electric Submersible Pump," which claims the benefit of and priority to U.S. Provisional Application Ser. No. 61/491,017 filed May 27, 2011 by Giusti, and entitled "Safety Valve System for Cable Deployed Electric Submersible Pump" and U.S. Provisional Application Ser. No. 61/504,035 filed Jul. 1, 2011 to Giusti, and entitled "Safety Valve System for Cable Deployed Electric Submersible Pump," each of which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations containing hydrocarbons to allow for recovery of the hydrocarbons. During the drilling and production of a hydrocarbon bearing formation, various procedures may be performed that involve temporarily isolating fluid flowing between the surface of a wellbore and the formation through a wellbore tubular. Such procedures can include flow control operations, completion operations, and/or interventions. The isolation of the wellbore typically involves the use of a mechanical component being disposed in the flow path to provide a seal. Any additional components disposed within the flow path may interfere with the ability of the mechanical components to form a seal, thereby preventing the isolation of the wellbore as needed.

SUMMARY

In an embodiment, a safety valve for downhole use in a well comprises a valve body having a longitudinal bore for fluid flow; a bore closure assembly positioned to seal about a longitudinal cable within the bore; and a control assembly positioned and configured to actuate in response to a change in a control signal condition. The bore closure assembly may comprise a drive mechanism coupled to a sealing element, wherein the longitudinal cable passes through the sealing element. The sealing element may comprise a resilient bushing configured to engage the longitudinal cable upon closing of the valve. The sealing element may comprise a plurality of cup portions configured to engage the longitudinal cable upon closing of the valve. The sealing element may comprise an inflatable element configured to expand and engage the longitudinal cable in response to having a fluid disposed therein. The sealing element may comprise a resilient member configured to expand and engage the longitudinal cable in response to being longitudinally compressed. The drive mechanism may comprise a hydraulic piston assembly configured in a compressed state upon the application of a hydraulic control signal to a surface of the piston, and/or the drive mechanism may comprise an electrically actuated piston. The drive mechanism further comprises a wedge coupled to the piston assembly for engaging the sealing element, and/or the drive mechanism may comprise a plurality of piston assemblies configured in a compressed state upon the application of a control signal to a surface of the pistons. The drive mechanism may comprise one or more springs configured to oppose a fluid force provided by the control signal, and the one or more springs may be configured to actuate the drive assembly in the modification, change, or absence of the control signal. The longitudinal cable may comprise an electric line, and the system may also include an electric submersible pump coupled to the longitudinal cable below the safety valve.

In an embodiment, a method of producing a fluid from a well comprises disposing a longitudinal cable within a wellbore tubular string and producing a fluid from the well. The wellbore tubular string comprises: a safety valve comprising: a valve body having a longitudinal bore for fluid to flow through; a bore closure assembly comprising a sealing element disposed within the valve body being positioned to seal about a longitudinal cable within the bore; and a control assembly positioned and configured to maintain the bore closure assembly in an open position in response to a control signal and to release the safety valve to a closed position in the absence of a control signal. The method may also include isolating a first portion of the wellbore above the safety valve from a second portion of the wellbore below the safety valve. Isolating may comprise reducing the control signal to release the safety valve. The longitudinal cable may pass through a central bore of the safety valve. The sealing element may comprise a plurality of cup portions configured to engage the longitudinal cable upon closing of the valve. The sealing element may comprise an inflatable element configured to expand and engage the longitudinal cable in response to having a fluid disposed therein. The sealing element may comprise a resilient member configured to expand and engage the longitudinal cable in response to being longitudinally compressed.

In an embodiment, a method comprises producing a hydrocarbon from a wellbore comprising a work string, wherein the work string comprises a safety valve having a longitudinal cable disposed therethrough, wherein the safety valve comprises: a valve body having a longitudinal bore for fluid to flow therethrough, wherein the longitudinal cable is disposed within the longitudinal bore; a bore closure assembly configured to sealing engage the longitudinal cable within the longitudinal bore in a closed position; and a control assembly positioned and configured to maintain the bore closure assembly in an open position in response to a control signal and to release the valve to the closed position in the modification, change, or absence of a control signal; and isolating a first portion of the wellbore above the safety valve from a second portion of the wellbore below the safety valve using the safety valve.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
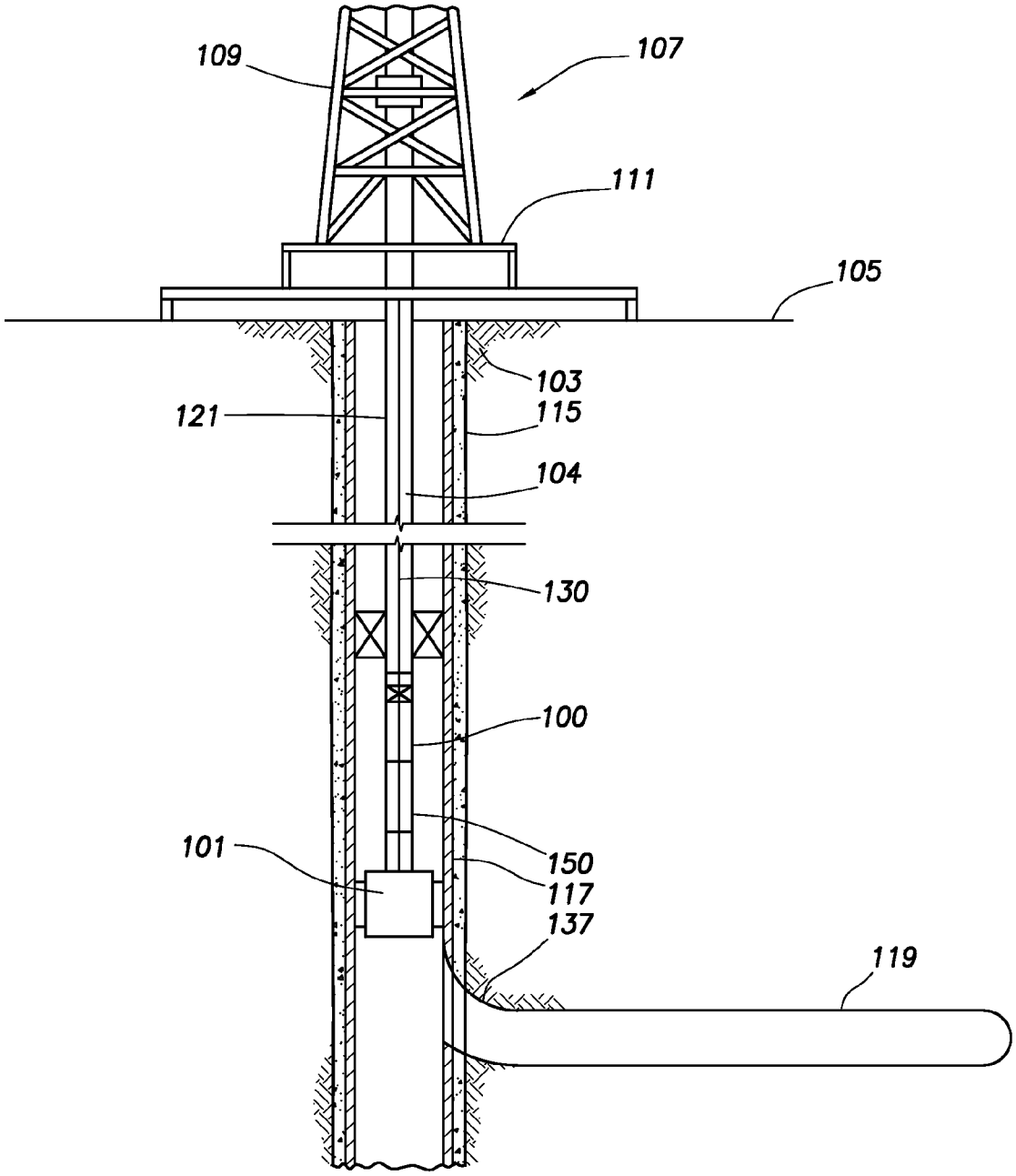
FIG. 1 is a schematic view of an embodiment of a subterranean formation and wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The various characteristics mentioned above, as well as other features and characteristics described in more detail below, will be readily apparent to those skilled in the art with the aid of this disclosure upon reading the following detailed description of the embodiments, and by referring to the accompanying drawings.

A safety valve may be employed within a well or a wellbore tubular string to enable the flow of fluids from within the well to be isolated during use. Various electrical components can be used within wellbores that require an electrical connection in order to function. When the electrical connection (e.g., a cable) passes through a safety valve, the sealable path may be blocked, thereby preventing the safety valve from forming a seal and isolating the flow of fluids within the well. The work string described herein allows a safety valve function to be maintained even while using a cable deployed downhole tool such as an electrical component deployed below the safety valve.

Turning to FIG. 1, an example of a wellbore operating environment is shown. As depicted, the operating environment comprises a drilling rig 107 that is positioned on the earth's surface 105 and extends over and around a wellbore 115 that penetrates a subterranean formation 103 for the purpose of recovering hydrocarbons. The wellbore 115 may be drilled into the subterranean formation 103 using any suitable drilling technique. The wellbore 115 extends substantially vertically away from the earth's surface 105 over a vertical wellbore portion 117, deviates from vertical relative to the earth's surface 105 over a deviated wellbore portion 137, and transitions to a horizontal wellbore portion 119. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy and/or the production of water (e.g., potable water).

A wellbore tubular string 121 including a work string comprising the safety valve as described herein may be lowered into the subterranean formation 103 for a variety of drilling, completion, production, workover, and/or treatment procedures throughout the life of the wellbore. The embodiment shown in FIG. 1 illustrates the wellbore tubular 121 in the form of a completion and/or work string being lowered into the subterranean formation. It should be understood that the wellbore tubular 121 is equally applicable to any type of wellbore tubular being inserted into a wellbore, including as non-limiting examples drill pipe, production tubing, rod strings, and coiled tubing. In the embodiment shown in FIG. 1, the wellbore tubular 121 comprising the safety valve may be conveyed into the subterranean formation 103 in a conventional manner.

The drilling rig 107 comprises a derrick 109 with a rig floor 111 through which the wellbore tubular 121 extends downward from the drilling rig 107 into the wellbore 115. The drilling rig 107 comprises a motor driven winch and other associated equipment for extending the wellbore tubular 121 into the wellbore 115 to position the wellbore tubular 121 at a selected depth. While the operating environment depicted in FIG. 1 refers to a stationary drilling rig 107 for lowering and setting the wellbore tubular 121 comprising the running tool within a land-based wellbore 115, in alternative embodiments, mobile workover rigs, wellbore servicing units (such as coiled tubing units), and the like may be used to lower the wellbore tubular 121 comprising the running tool into a wellbore. It should be understood that a wellbore tubular 121 comprising the running tool may alternatively be used in other operational environments, such as within an offshore wellbore operational environment. In alternative operating environments, a vertical, deviated, or horizontal wellbore portion may be cased and cemented and/or portions of the wellbore may be uncased.

Regardless of the type of operational environment in which the safety valve is used, it will be appreciated that the safety valve allows a safety valve function to be maintained even while using a cable deployed downhole tool such as an electrical component 101 deployed below the safety valve. In an embodiment, the safety valve function is maintained through the safety valve 100 when the cable 130 is disposed within the central flow path 104. The safety valve 100 may also provide a safety valve function when the cable 130 is not disposed within the central flow path 104, and/or an additional safety valve may be used to provide a safety valve function when the cable 130 is not disposed within the central flow path 104.

Figure 2:
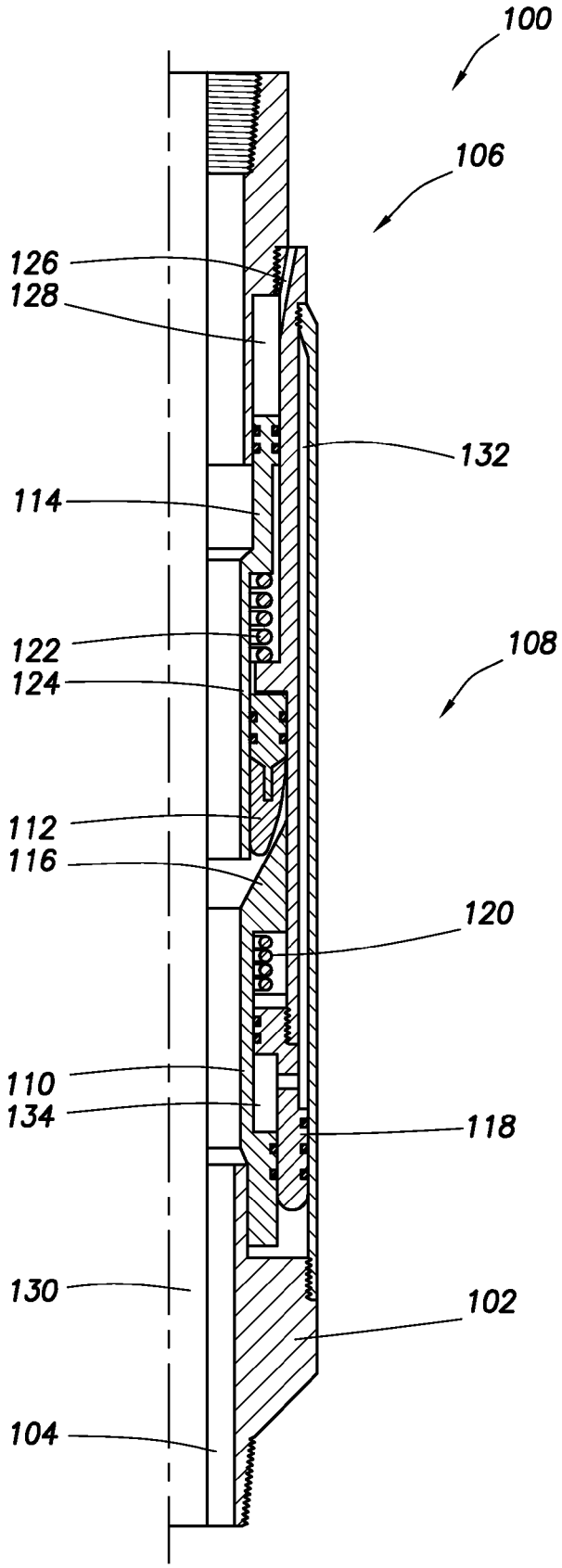
FIG. 2 is a half cross-section of a safety valve according to an embodiment.
Figure 3:
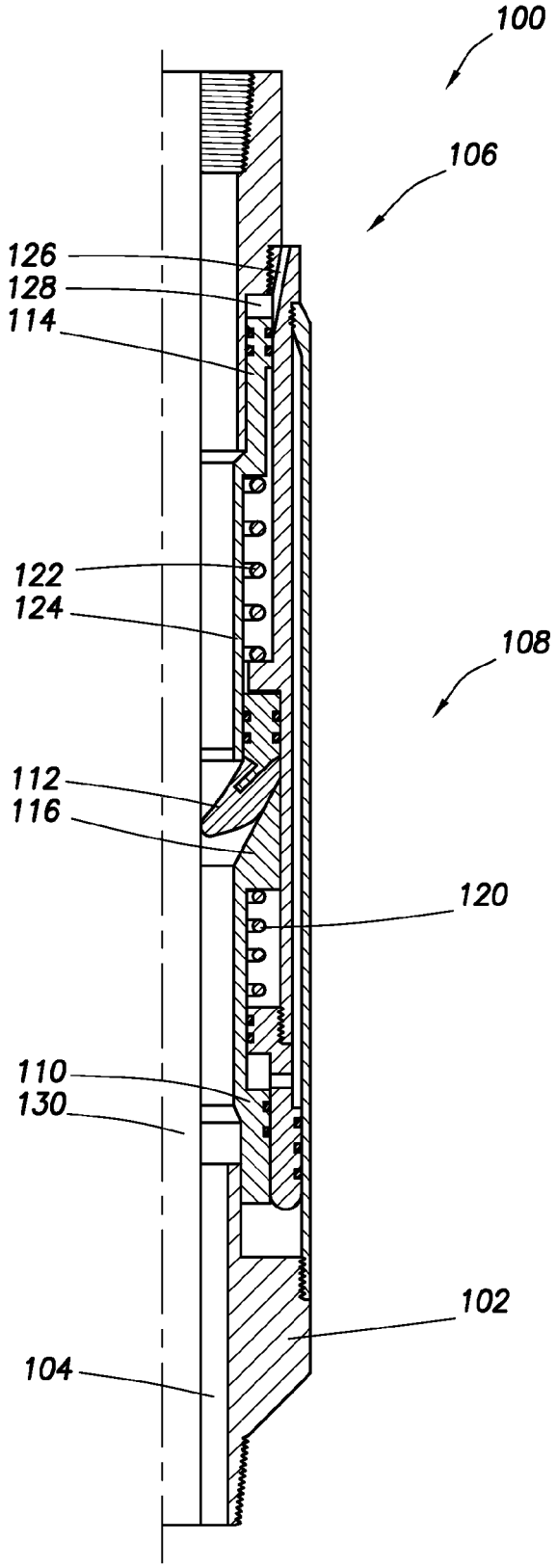
FIG. 3 is another half cross-section of a safety valve according to an embodiment.

As described in more detail with respect to FIGS. 2 and 3, a safety valve 100 for downhole use in a well comprises a valve body 102 having a longitudinal bore 104 for fluid to flow through, a bore closure assembly 106 being positioned to seal about a longitudinal cable 130 within the bore 104, and a control assembly 108 positioned and configured to maintain the bore closure assembly in an open position in response to a control signal and to release the valve to the closed position in the modification, change and/or absence of a control signal. In an embodiment, the control assembly 108 may be positioned and configured to actuate in response to a change in a control signal condition. For example, the control signal condition may comprise receiving a control signal when one had not been received, loosing a control signal when one was being received, or receiving a change in the magnitude or type of control signal being received. The safety valve may be used in addition to one or more additional safety valves of similar or dissimilar design to act as redundant safety backups. In addition, the additional safety valves may comprise traditional seal elements to shut off the well when the cable is not disposed within the well. For example, traditional ball type safety valves and/or flapper type safety valves may be used to shut off the well when the cable is not disposed within the well and/or passing through the safety valves.

The bore closure assembly 106 may comprise a drive mechanism 114 coupled to or engaged with a sealing element 112, and the drive mechanism 114 may be configured to rotate the sealing element 112 into the longitudinal bore 104 and/or move out of engagement with the sealing element 112 to allow the sealing element 112 to extend into the longitudinal bore 104. The drive mechanism 114 may comprise any drive mechanism known in the art to effect a movement of one or more components in a well bore. For example, the drive mechanism 114 may effect a movement in response to a fluid pressure, an electrical signal, a rotational force, a longitudinal force, or any combination thereof. In an embodiment, the drive mechanism 114 may comprise a piston assembly configured in a compressed state upon the application of a control signal to a surface of the piston. As another example, the drive mechanism may comprise an electrically actuated piston. As still another example, the drive mechanism may comprise a plurality of piston assemblies configured in a compressed state upon the application of a control signal to a surface of the pistons. In this embodiment, the modification, change, and/or release of the control signal may result in the actuation of the bore closure assembly 106.

In an embodiment, the sealing element 112 may comprise a plurality of cup portions configured to engage the longitudinal cable 130 upon closing of the safety valve 100. In this embodiment, the cup portions may be biased to extend into the longitudinal bore 104 of the safety valve 100 without any other biasing mechanism, though other biasing mechanisms may be used to provide additional sealing force between the cup portions and a longitudinal cable 130 disposed within the longitudinal bore 104. In other embodiments, the sealing element 112 may comprise suitable sealing elements. In some embodiments, a bushing may be disposed about the longitudinal cable 130, and the sealing element 112 may be configured to engage the bushing. This may allow the sealing elements 112 to travel a shorter distance from the valve body 102 in order to form the sealing engagement with the bushing. The bushing may in turn be sealingly engaged with the longitudinal cable 130. In an embodiment, the sealing element 112 may be fixedly engaged with the valve body, or the sealing element may be pivotably engaged with the valve body. When fixedly engaged, only a portion of the sealing element may extend into the longitudinal bore. In some embodiments, the sealing element may be pivotably engaged with the valve body, thereby allowing a portion or all of the sealing element to pivot into the longitudinal bore. The sealing element may be configured to maintain a sealing engagement with the valve body when pivoting into the longitudinal bore.

For example, the sealing element may comprise a resilient bushing through which the longitudinal cable passes. Upon activation of the control assembly 108, a wedge 116 may engage the resilient bushing to affect a seal about the cable 130. In another embodiment, the sealing element may comprise an inflatable element configured to expand and engage the longitudinal cable in response to having a fluid disposed therein. For example, the control assembly 108 may be configured to provide a fluid to the inflatable element in response to a control signal (e.g., a fluid pressure, an electrical signal, a mechanical force, etc.). In still another embodiment, the sealing element may comprise a resilient member configured to expand and engage the longitudinal cable in response to being longitudinally compressed. For example, one or more drive mechanisms may be used to compress the resilient member, thereby affecting an inward expansion of the resilient member against the cable to form a seal.

FIGS. 2 and 3 illustrate an embodiment of the safety valve 100. In this embodiment, the safety valve 100 may comprise a portion of a work string or completion string, and/or the safety valve 100 may comprise a cable or tubing retrievable safety valve disposed within the work string (e.g., work string 121 of FIG. 1). The safety valve 100 comprises a valve body 102 comprising a generally tubular member having a longitudinal bore 104 extending between a first end and a second end. The first end and second end may be configured to engage and/or be coupled to one or more additional components above and/or below the safety valve 100. For this purpose, the first end and/or the second end may comprise suitable internal or external threads (e.g., tapered threads). Alternatively, other types of connections may be used to couple the safety valve 100 to another component. The cable 130 and any downhole components (e.g., an electric submersible pump) may pass through the longitudinal bore 104 and the cable 130 may remain disposed within the longitudinal bore 104.

The bore closure assembly 106 generally comprises a piston 114 coupled to an internally disposed and generally cylindrical flow tube 124. The bore closure assembly 106 comprises a flow passage 126 extending internally from a control line inlet to the interior of the bore closure assembly 106 within a piston chamber 128. A conventional tube fitting may be used to couple a relatively small diameter control line to the control line inlet. The control line may extend to the earth's surface and is conventionally secured to the tubular string with, for example, straps at suitable intervals. Fluid pressure may be applied to the control line at the earth's surface with a pump.

When sufficient fluid pressure has been applied to the control line, the pressure may be communicated to the piston chamber 128 to actuate the piston 114. The piston 114 generally comprises two radially spaced apart circumferential seals. Fluid pressure supplied through the control line may cause the piston 114 to move downward due to the differential piston area formed between the radially spaced apart seals. The piston 114 is axially displaced downward against an upward bias force from spring 122. Thus, in order to axially downwardly displace the piston 114 relative to the bore closure assembly 106 housing, fluid pressure applied to the control line and acting on the piston 114 must produce a force oppositely directed to, and greater than, that exerted by the spring 122. While described as a spring 122, any biasing member other than a spring 122 may be utilized in the safety valve 100 without departing from the principles of the present invention, including for example, a chamber of compressible gas. When downwardly displaced, the piston may displace the flow tube 124 downward and about a sealing element 112, thereby forcing the sealing element outward (e.g., towards body 102 and away from cable 130).

The control assembly 108 generally comprises a second piston 110 coupled to an internally disposed wedge 116. The control assembly 108 comprises a second flow passage 132, which may be in fluid communication with the flow passage 126, extending internally from a control line inlet to the interior of the control assembly 108 housing 118 within a piston chamber 134. When sufficient fluid pressure has been applied to the control line, the pressure may be communicated to the piston chamber 134 to actuate the second piston 110. The second piston 110 generally comprises two radially spaced apart circumferential seals. Fluid pressure supplied through the control line may cause the second piston 110 to move downward due to the differential piston area formed between the radially spaced apart seals. The second piston 110 is axially displaced downward against an upward biasing force from spring 120. Thus, in order to axially downwardly displace the second piston 110 relative to the control assembly 108 housing 118, fluid pressure applied to the control line and acting on the second piston 110 must produce a force oppositely directed to, and greater than, that exerted by the spring 120. When downwardly displaced, the second piston 110 may displace the wedge 116 downwardly and out of engagement with the sealing element 112.

When the fluid pressure is sufficient to displace the piston 114 and the second piston 110 downward, the safety valve 100 is in its "open" configuration. In this configuration, the sealing element 112 may be outwardly displaced by flow tube 124 and the longitudinal bore 104 may have a relatively constant inner diameter to allow the cable 130 and any associated downhole components to be conveyed through the safety valve 100.

Upon loss of a control signal, upon a change in the control signal, upon reception of a closure signal, and/or when the fluid pressure acting on the piston 114 and the second piston 110 is insufficient to downwardly displace or maintain the pistons 114, 110 in the open configuration, the pistons 114, 110 may both move upwards to transition the safety valve to its "closed" configuration. As shown in FIG. 3, the piston 114 may move upwards when the fluid pressure is reduced due to the biasing force of the spring 122. In this position, the flow tube 124 may move upwards with the piston and rise above and out of radial alignment with the sealing element 112. The second piston 110 may also be displaced upward due to the biasing force of the spring 120, thereby displacing the wedge 116 upward with the piston 110. The wedge 116 may engage an outer surface of the sealing element 112 between the body 102 and the sealing element 112, causing the sealing element to extend into the longitudinal bore 104. When the cable 130 is disposed within the longitudinal bore 104, the sealing element 112 may engage the cable 130, and in an embodiment, the sealing element 112 may form a sealing engagement with the cable 130. In an embodiment, a bushing may be coupled to the cable so that the cup portions 112 have a mating surface against which to form a seal. In an embodiment, a locking mechanism may optionally be incorporated to prevent premature release of the control assembly 108.

The various safety valve embodiments may be used to form a seal with any cable or tubular components. In an embodiment, the longitudinal cable may comprise an electric line, which may be used to couple to and power an electric component. For example, an electric submersible pump may be coupled to the longitudinal cable below the safety valve.

In an embodiment, one or more additional safety valves may be used in combination with the safety valve disclosed herein. For example as shown in FIG. 1, an additional safety valve 150 may be disposed in series with (e.g., below and/or above) the safety valve 100. The additional safety valve 150 comprises traditional seal elements to shut off the well when the cable is not disposed within the well. For example, traditional ball type safety valves and/or flapper type safety valves may be used to shut off the well when the cable is not disposed within the well and/or passing through the safety valves. In this embodiment, the safety valve function may be maintained through the safety valve 100 disclosed herein and/or the additional safety valve 150 when the cable 130 is not disposed within the wellbore 115.

In an embodiment, the additional safety valve 150 may comprise a flapper-type safety valve. A flapper-type safety valve generally comprises a tubular body member with a longitudinal bore (e.g., sealable flow path) that extends therethrough. An actuator, usually referred to as a flow tube, may be disposed within the body member and is configured to longitudinally translate between the open position of the safety valve and the closed position of the safety valve within the body member. A biasing member such as a spring may be disposed about the actuator act upon the actuator, thereby biasing the actuator away from a sealing element, which is usually referred to as a flapper. The sealing element is pivotably mounted via a hinge within the body member to control fluid flow through the longitudinal bore. In an embodiment, a rod-piston system, or other hydraulic operating piston, such as an annular piston may be provided to controllably translate the actuator within the longitudinal bore, and to actuate the sealing element between an open position and a closed position and/or a closed position and an open position. The safety valve may generally comprise a control line inlet that can be connected to a control line and provide a control fluid to the piston. Once connected, the control line is configured to be in fluid communication with a piston disposed within a piston rod chamber. A first end of the piston may be in contact with hydraulic fluid provided thereto through the control line. A second end of the piston is operatively connected, in any suitable manner, to the actuator. When the pressure of hydraulic fluid in the control line exceeds the force needed to compress the biasing member, the piston is forced downwardly, thereby causing the actuator to come into contact with, and open, the sealing element. In the event that the hydraulic pressure applied to the piston is decreased, the biasing member forces the actuator upwardly away from the closure member. The closure member is then rotated, and biased, into a closed position by action of a hinge spring to a normally closed position to prevent fluid flow into the actuator and through the longitudinal bore.

In an embodiment, the additional safety valve 150 may comprise a ball valve. A ball valve generally comprises a variety of components to provide a seal (e.g., a ball/seat interface) and actuate a ball disposed within a body of the valve. A ball valve assembly may comprise cylindrical retaining members disposed on opposite sides of the ball. One or more seats or seating surfaces may be disposed above and/or below the ball to provide a fluid seal with the ball. The ball generally comprises a truncated sphere having planar surfaces on opposite sides of the sphere. Planar surfaces may each have a spigot comprising a projection (e.g., cylindrical projections) extending outwardly therefrom, and a radial groove extending from the spigots to the edge of the planar surface. An actuation member having two parallel arms may be positioned about the ball and the retaining members. The spigots may be received in windows through each of the arms. Actuation pins may be provided on each of the inner sides of the arms, and the pins may be received within the grooves on the ball. In the open position, the ball is positioned so as to allow the flow of fluid through the ball valve by allowing fluid to flow through an interior fluid passageway (e.g., a bore or hole) extending through the ball. The interior flow passage may have its longitudinal axis disposed at about 90 degrees to the longitudinal axis when the ball is in the closed position, and the interior flow passage may have its longitudinal axis substantially aligned with the longitudinal axis when the ball is in the open position The ball may be rotated by linear movement of the actuation member along the longitudinal axis. The pins move as the actuation member moves, causing the ball to rotate due to the positioning of the pins within the grooves on the ball. During operation, the ball is actuated from an open position to a closed position by rotating the ball such that the interior flow passage is rotated out of alignment with the flow of fluid, thereby forming a fluid seal with one or more seats or seating surfaces and closing the valve. Similarly, the ball is actuated from a closed position to an open position by rotating the ball such that the interior flow passage is rotated into alignment with the flow of fluid.

In an embodiment, a method of producing a fluid from a well comprises disposing a longitudinal cable within a wellbore tubular string, where the wellbore tubular string comprises: a safety valve comprising: a valve body having a longitudinal bore for fluid to flow through; a bore closure assembly comprising a sealing element disposed within the valve body being positioned to seal about a longitudinal cable within the bore; a control assembly positioned and configured to maintain the bore closure assembly in an open position in response to a control signal and to release the safety valve in the modification, change, and/or absence of a control signal, and a control line coupled to the safety valve, and producing a fluid from the well. The wellbore safety valve may comprise any of the additional safety valves described herein. When an additional safety valve is present, the additional safety valve may be opened prior to disposing the longitudinal cable within the wellbore to allow for passage of the cable and any associated downhole components (e.g., an electric submersible pump) to be disposed through the safety valve.

The safety valve may be used to isolate a first portion of the wellbore above the safety valve from a second portion of the wellbore below the safety valve. For example, a control signal in the control line coupled to the safety valve may be reduced to release the safety valve to a closed position and form a seal. Upon forming a seal with the cable, the portion of the wellbore above the safety valve may be substantially isolated from a portion of the wellbore below the safety valve. Upon removal of the cable and any associated equipment, the wellbore safety valve may remain in the well and be used to isolate the flow of fluids within the wellbore. In an embodiment in which an additional safety valve is present, the additional safety valve may be used alone or in combination with the safety valve 100 to isolate the flow of fluids within the wellbore. As a result, fluid production can be isolated with or without the cable deployed electric component within the well.

Having described the systems and methods, various embodiments may include, but are not limited to:

1. In an embodiment, a safety valve for downhole use in a well comprises a valve body having a longitudinal bore for fluid to flow through; a bore closure assembly configured to sealing engage a longitudinal cable within the longitudinal bore in a closed position; and a control assembly positioned and configured to maintain the bore closure assembly in an open position in response to a control signal and to release the valve to the closed position in the absence of a control signal.

2. The safety valve of embodiment 1, wherein the bore closure assembly comprises a drive mechanism coupled to a sealing element.

3. The safety valve of embodiment 2, wherein the sealing element comprises a resilient bushing through which the longitudinal cable passes.

4. The safety valve of embodiment 2 or 3, wherein the sealing element comprises a plurality of cup portions configured to engage the longitudinal cable upon closing of the valve.

5. The safety valve of any of embodiments 2 to 4, wherein the sealing element comprises an inflatable element configured to expand and engage the longitudinal cable in response to having a fluid disposed therein.

6. The safety valve of any of embodiments 2 to 5, wherein the sealing element comprises a resilient member configured to expand and engage the longitudinal cable in response to being longitudinally compressed.

7. The safety valve of any of embodiments 2 to 6, wherein the drive mechanism comprises a piston assembly configured in a compressed state upon the application of a control signal to a surface of the piston.

8. The safety valve of any of embodiments 2 to 7, wherein the drive mechanism comprises an electrically actuated piston.

9. The safety valve of embodiment 7 or 8, wherein the drive mechanism further comprises a wedge coupled to the piston for engaging the sealing element.

10. The safety valve of any of embodiments 2 to 9, wherein the drive mechanism comprises a plurality of piston assemblies configured in a compressed state upon the application of a control signal to a surface of the pistons.

11. The safety valve of any of embodiments 2 to 10, wherein the drive mechanism comprises one or more springs configured to oppose a fluid force provided by the control signal, wherein the one or more springs are configured to actuate the drive assembly in the absence of the control signal.

12. The safety valve of any of embodiments 1 to 11, wherein the longitudinal cable comprises an electric line.

13. The system of embodiment 12, further comprising an electric submersible pump coupled to the longitudinal cable below the safety valve.

14. In an embodiment, a method of producing a fluid from a well comprises disposing a longitudinal cable within a wellbore tubular string and producing a fluid from the well. The wellbore tubular string comprises: a wellbore safety valve; a second safety valve comprising: a valve body having a longitudinal bore for fluid to flow through; a bore closure assembly comprising a sealing element disposed within the valve body being positioned to seal about a longitudinal cable within the bore; and a control assembly positioned and configured to maintain the bore closure assembly in an open position in response to a control signal and to release the second safety valve to a closed position in the absence of a control signal.

15. The method of embodiment 14, further comprising isolating a first portion of the wellbore above the second safety valve from a second portion of the wellbore below the second safety valve.

16. The method of embodiment 15, wherein the isolating comprises reducing the control signal to release the second safety valve.

17. The method of any of embodiments 14 to 16, wherein the longitudinal cable passes through a central bore of the wellbore safety valve.

18. The method of any of embodiments 14 to 17, wherein the sealing element comprises a plurality of cup portions configured to engage the longitudinal cable upon closing of the valve.

19. The safety valve of any of embodiments 14 to 18, wherein the sealing element comprises an inflatable element configured to expand and engage the longitudinal cable in response to having a fluid disposed therein.

20. The safety valve of any of embodiments 14 to 19, wherein the sealing element comprises a resilient member configured to expand and engage the longitudinal cable in response to being longitudinally compressed.

21. In an embodiment, a safety valve for downhole use in a well comprises a valve body having a longitudinal bore for fluid flow; a bore closure assembly positioned to seal about a longitudinal cable within the bore; and a control assembly positioned and configured to actuate in response to a change in a control signal condition.

22. In an embodiment, a safety valve for downhole use in a well comprises: a valve body having a longitudinal bore for fluid to flow therethrough; a bore closure assembly comprising a sealing element and a first piston, wherein the first piston is coupled to a flow tube, wherein the first piston and flow tube are configured to allow the sealing element to sealingly engage a longitudinal cable within the longitudinal bore in a closed position; wherein the first piston is configured to move the flow tube out of radial alignment with the sealing element in the closed position, wherein the sealing element comprises a cup portion, wherein the cup portion is configured to extend into the longitudinal bore when out of radial alignment with the flow tube, wherein the first piston and flow tube are configured to engage the sealing element and move the sealing element out of engagement with the longitudinal cable within the longitudinal bore in an open position, wherein the first piston is configured to move the flow tube into radial alignment with the sealing element in the open position, wherein the cup portion is moved outward by the flow tube when radially aligned with the flow tube; wherein the safety valve further comprises a first spring configured to move the flow tube out of radial alignment with the sealing element in response to the modification, change, or absence of a control signal, wherein the safety valve further comprises a control assembly comprising a second piston and a wedge, wherein the second piston is configured to maintain the wedge out of engagement with the sealing element in an open position, wherein the second piston is configured to maintain the wedge out of engagement with the sealing element in response to a control signal, wherein the second piston is configured to release and allow the wedge to engage the sealing element in the closed position, wherein the second piston is configured to release in response to the modification, change, or absence of a control signal, wherein the wedge is configured to engage the sealing element between the sealing element and the valve body, wherein the wedge is configured to bias the sealing element into contact with the longitudinal cable within the longitudinal bore when engaged with the sealing element, wherein the safety valve further comprises a second spring configured to move the second piston and wedge into engagement with the sealing element in response to the modification, change, or absence of a control signal. The safety valve may also include a bushing disposed about the longitudinal cable, wherein the sealing element is configured to sealingly engage the bushing in the closed position.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A safety valve for downhole use in a well comprising:

a valve body having a longitudinal bore for fluid flow;

a bore closure assembly positioned to seal about a longitudinal cable within the bore, wherein bore closure assembly comprises a first flow passage extending internally from a control line inlet to an interior of the bore closure assembly; a control line coupled to the control line inlet; and a control assembly positioned and configured to actuate in response to a change in a control signal condition, wherein the control assembly comprises a second flow passage fluidically, coupled to the first flow passage, that extends internally from the control line inlet to an interior of the control assembly, and wherein the change in a control signal condition comprises a change in a fluid pressure applied to the control line.

2. The safety valve of claim 1, wherein the bore closure assembly comprises a drive mechanism coupled to a sealing element, wherein the longitudinal cable passes through the sealing element.

3. The safety valve of claim 2, wherein the sealing element comprises a resilient bushing configured to engage the longitudinal cable upon closing of the valve.

4. The safety valve of claim 2, wherein the sealing element comprises a plurality of cup portions configured to engage the longitudinal cable upon closing of the valve.

5. The safety valve of claim 2, wherein the sealing element comprises a resilient member configured to expand and engage the longitudinal cable in response to being longitudinally compressed.

6. The safety valve of claim 2, wherein the drive mechanism comprises a hydraulic piston assembly configured in a compressed state upon the application of a hydraulic control signal to a surface of the piston.

7. The safety valve of claim 6, wherein the drive mechanism further comprises a wedge coupled to the piston assembly for engaging the sealing element.

8. The safety valve of claim 2, wherein the drive mechanism comprises a plurality of piston assemblies configured in a compressed state upon the application of the change in fluid pressure to a surface of the pistons.

9. The safety valve of claim 2, wherein the drive mechanism comprises one or more springs configured to oppose a fluid force provided by the control signal, wherein the one or more springs are configured to actuate the drive assembly in the modification, change, or absence of the control signal.

10. The safety valve of claim 1, wherein the longitudinal cable comprises an electric line.

11. The system of claim 10, further comprising an electric submersible pump coupled to the longitudinal cable below the safety valve.

12. A method of producing a fluid from a well comprising:

disposing a longitudinal cable within a wellbore tubular string, wherein the wellbore tubular string comprises:

a safety valve comprising:

a valve body having a longitudinal bore for fluid to flow through;

a bore closure assembly comprising a sealing element disposed within the valve body being positioned to seal about the longitudinal cable within the bore, wherein bore closure assembly comprises a first flow passage extending internally from a control line inlet to an interior of the bore closure assembly;

a control line coupled to the control line inlet; and a control assembly positioned and configured to maintain the bore closure assembly in an open position in response to a control signal and to release the safety valve to a closed position in the absence of a control signal, wherein the control assembly comprises a second flow passage, fluidically coupled to the first flow passage, that extends internally from the control line inlet to an interior of the control assembly, and wherein the change in a control signal condition comprises a change in a fluid pressure applied to the control line; and producing a fluid from the well.

13. The method of claim 12, further comprising isolating a first portion of the wellbore above the safety valve from a second portion of the wellbore below the safety valve.

14. The method of claim 13, wherein the isolating comprises reducing the pressure applied to the control line to close the safety valve.

15. The method of claim 12, wherein the longitudinal cable passes through a central bore of the safety valve.

16. The method of claim 12, wherein the sealing element comprises a plurality of cup portions configured to engage the longitudinal cable upon closing of the valve.

17. The safety valve of claim 12, wherein the sealing element comprises a resilient member configured to expand and engage the longitudinal cable in response to being longitudinally compressed.

18. A method comprising:

producing a hydrocarbon from a wellbore comprising a work string, wherein the work string comprises a safety valve having a longitudinal cable disposed therethrough, wherein the safety valve comprises:

a valve body having a longitudinal bore for fluid to flow therethrough, wherein the longitudinal cable is disposed within the longitudinal bore;

a bore closure assembly configured to sealing engage the longitudinal cable within the longitudinal bore in a closed position, wherein bore closure assembly comprises a first flow passage extending internally from a control line inlet to an interior of the bore closure assembly;

a control line coupled to the control line inlet; and a control assembly positioned and configured to maintain the bore closure assembly in an open position in response to a control signal and to release the valve to the closed position in the modification, change, or absence of a control signal, wherein the control assembly comprises a second flow passage fluidically coupled to the first flow passage that extends internally from the control line inlet to an interior of the control assembly, and wherein the change in a control signal condition comprises a change in a fluid pressure applied to the control line; and isolating a first portion of the wellbore above the safety valve from a second portion of the wellbore below the safety valve using the safety valve.

* * * * *